United States Patent [19]

Mason

[11] 4,417,660

[45] Nov. 29, 1983

[54] CARTON FOR PACKAGING LAMP SHADES OR THE LIKE

[75] Inventor: James J. Mason, Olympia Fields, Ill.

[73] Assignee: Cameo Container Corporation, Chicago, Ill.

[21] Appl. No.: 359,103

[22] Filed: Mar. 17, 1982

Related U.S. Application Data

[63] Continuation-in-part of Ser. No. 299,859, Sep. 8, 1981.

[51] Int. Cl.[3] ..... B65D 85/62

[52] U.S. Cl. ..... 206/500; 206/491; 206/485; 206/488; 206/499; 229/40

[58] Field of Search ..... 206/334, 320, 395, 396, 206/289, 500, 408, 397, 413, 485, 491, 588, 327, 590, 499, 461, 488, 490, 509, 511, 394, 486; 229/40

[56] References Cited

U.S. PATENT DOCUMENTS

| | | | |
|---|---|---|---|
| 2,065,526 | 12/1936 | Huttinger | 206/394 |
| 2,181,198 | 11/1939 | Moskowitz | 206/500 |
| 2,801,744 | 8/1957 | White | 206/476 |
| 2,860,773 | 11/1958 | Zackheim | 206/394 |
| 3,118,538 | 1/1964 | Flashman | 206/500 |
| 3,124,249 | 3/1964 | Flashman | 206/500 |
| 3,172,534 | 3/1965 | Martin | 206/499 |
| 3,530,980 | 9/1970 | Link | 206/394 |
| 3,613,973 | 10/1971 | Jaeschke | 206/395 X |
| 3,900,101 | 8/1975 | Goodsite | 206/320 |
| 3,999,657 | 12/1976 | Doskocil | 206/289 |
| 4,131,198 | 12/1978 | Fischer | 206/486 X |

*Primary Examiner*—Steven M. Pollard
*Assistant Examiner*—Bryon Gehman
*Attorney, Agent, or Firm*—Silverman, Cass & Singer, Ltd.

[57] ABSTRACT

A shipping carton formed from corrugated paperboard or other suitable sheet material which can be erected from a foldable, unitary blank. The blank includes side wall panels and end flaps hingedly connected along opposing edges of side panels, which can be folded to form the top and bottom walls of the completed carton. At least one end flap in a top and bottom wall which are in registry have integrally formed anchoring flap means for securing in the carton an article, such as a conventional lamp shade, having a washer fitter through which an elongate rod or pole can be received with the opposite extremities of the rod or pole engaged in said anchoring flap means to prevent shifting of the lamp shade within the carton during shipment.

In the preferred embodiments of the carton, the anchoring flap means outwardly overlap the respective opposing end flap, with respect to the interior of the carton, and the opposing end flap is provided with a clearance passageway which allows the end of the rod to be inserted past the opposing end flap and into a receiving aperture in the anchoring flap means.

The anchoring flap means are further characterized by their construction and arrangement to engage even suitably configured protuberances on the packaged article itself to prevent such shifting within the carton.

17 Claims, 6 Drawing Figures

FIG. 1
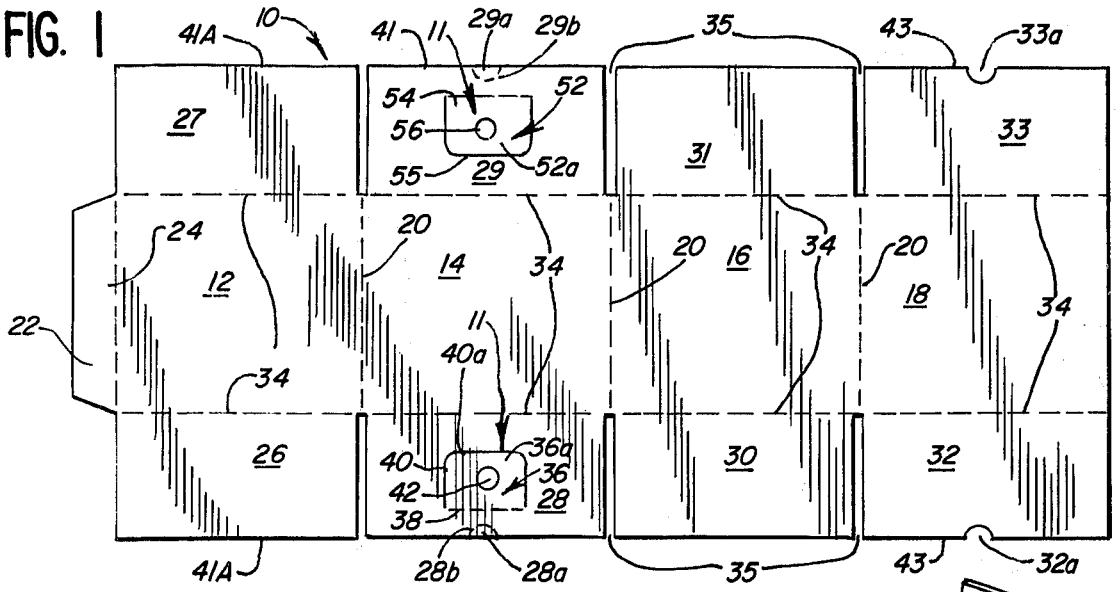
FIG. 2
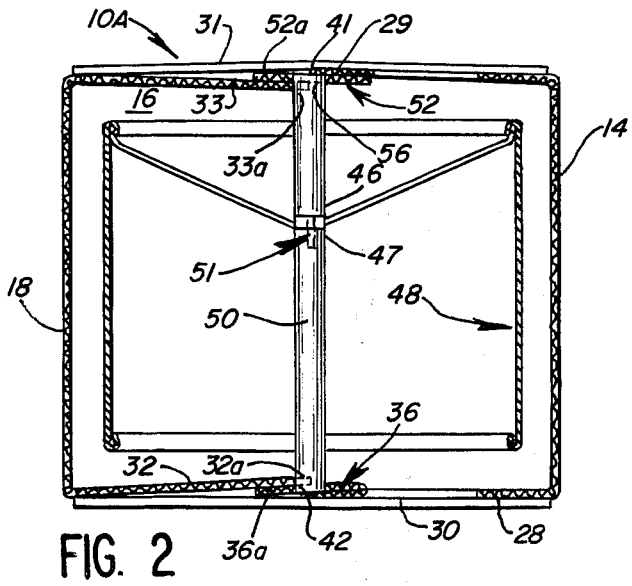
FIG. 3
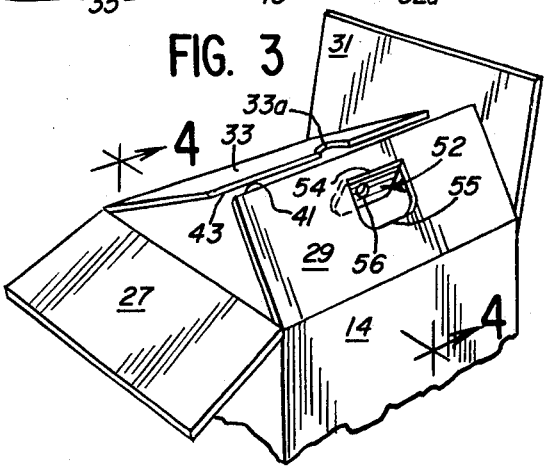
FIG. 4
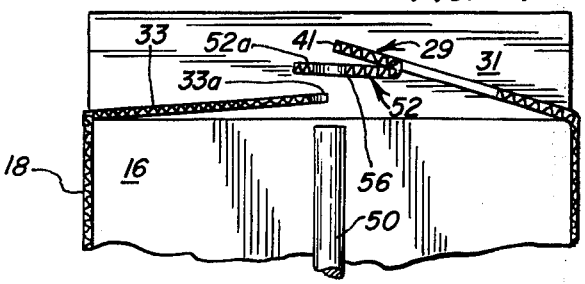
FIG. 5
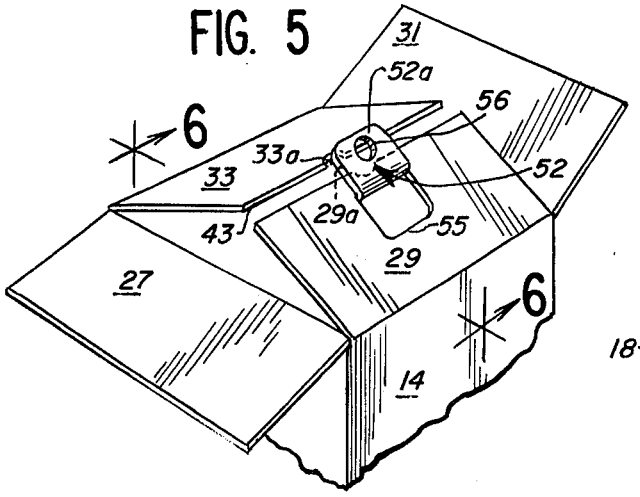
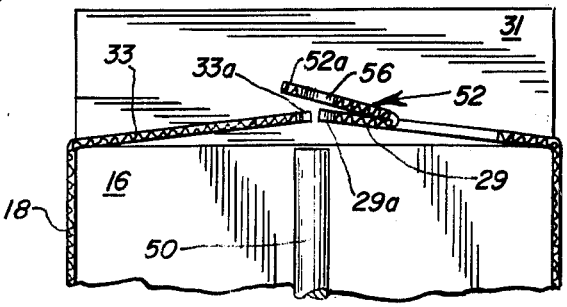
FIG. 6

CARTON FOR PACKAGING LAMP SHADES OR THE LIKE

CROSS-REFERENCE TO RELATED APPLICATION

This is a continuation-in-part of copending application, Ser. No. 299,859 filed Sept. 8, 1981, and entitled "Shiping Carton for Lamp Shades or the Like." Subject matter of application Ser. No. 299,859 common to this patent application is hereby specifically incorporated by reference so as to avoid unnecessary proliferation of the disclosure hereof.

BACKGROUND OF THE INVENTION

This invention relates generally to shipping cartons formed from corrugated paperboard or the like and more particularly, relates to an otherwise conventional carton formed from a unitary blank of sheet material which includes anchoring flap means integral with the blank, constructed and arranged to prevent shifting of a product packaged in the carton, such as a lamp shade or a similar suitably structured product.

Except for the novel anchoring flap means with which the invention is concerned, the carton is formed from a conventional corrugated paperboard blank. In the trade, it is known as a "R.S.C." style carton in which the blank has a series of hingedly connected side wall panels which are foldable into a rectangular enclosure secured by means of a conventional manufacturer's flap. Each side wall panel has a pair of end flaps along opposing edges thereof. Thus, there is a total of eight end flaps, four of which are folded to form the bottom wall and four of which are folded to form the top wall of the completed carton. Adhesive tape commonly is used for securing the end flaps into end wall structures. Such a carton can be partially assembled into a collapsed condition which makes the carton ideal for shipping in large quantities. When it is desired to use the carton, pressure applied to the edges of the carton will cause it to open into a rectangular shape. The top and bottom flaps can then be folded to complete the carton after the carton is loaded. Such a carton is commonly used for shipping of lamp shades.

A lamp shade of the type with which the carton of this invention is concerned normally has a wire frame provided by a top and bottom metal ring and supporting wire ribs secured between the rings. A suitable fabric cover is then supported on the frame. In some cases the frame comprises a self-supporting parchment member which includes top and bottom metal rings. To install the lamp shade on the upright stud of a lamp base, the lamp shade has a centrally positioned washer fitter which essentially is a washer member having a central aperture into which the stud of the lamp base can be inserted for engaging a suitable nut which can be tightened into engagement with a washer fitter. It may be noted that leaded glass lamp shades, commonly known as "Tiffany lamp shades," also have a washer fitter for mounting the lamp shade on a lamp base.

In order to package such a lamp shade in a conventional R.S.C. style carton, the practice has been to use separate inserts located adjacent the top and bottom walls of the completed carton. Such inserts were provided with apertures into which the opposing extremities of a rod or pole were inserted with the rod or pole passed through the washer fitter of the lamp shade. Of course, such separate inserts required separate manufacturing and handling expenses as well as requirements for storage and setup of the carton. All the inserts were configured to abut inside surfaces of the side walls of the carton so as to prevent shifting of the lamp in the carton during shipment which could bend the frame or damage the lamp shade material when the pole extremities were engaged in the apertures in the inserts.

The thrust of the herein invention is to eliminate the need for separate inserts by means of said anchoring flap means integral with selected end flaps of such a conventional R.S.C. style carton.

SUMMARY OF THE INVENTION

A protective shipping carton especially for lamp shades or the like is erected from an otherwise conventional unitary blank of corrugated paperboard or other suitable sheet material. The blank includes flap members hingedly connected to side wall panels capable of being folded to form the top and bottom walls of the completed carton. Intergral anchoring flap means are formed in selected end flaps of the carton which are foldable into the interior of the carton subtending other end flap members. A selected pair of such end flaps have the integral, hingedly connected anchoring flap means capable of being folded through a 180° angle into back-to-back configuration outwardly or, alternatively, inwardly from the end flap to which the anchoring flap is connected. In either of these alternative configurations, a portion of the anchoring flap means generally overlaps a respective opposing one of the end flaps. The anchoring flap means have axially aligned apertures located to receive the ends of a rigid rod or pole which has been inserted through the washer fitter of a lamp shade. When the anchoring flap means outwardly overlap the respective opposing end flap with respect to the interior of the carton, the opposing end flap is provided with a clearance passageway to allow the end of the rod to pass through the opposing end flap and into the receiving aperture of the anchoring flap.

In this assembled condition of the carton with the lamp shade packaged therein, the integral anchoring flap means cooperate with the rod or pole to prevent shifting of the lamp shade during shipment of the carton and thereby prevent inadvertent bending of the lamp shade frame or damage to the lamp shade material. The aperture of the anchoring flap means will be covered by the end flaps forming the exterior of the end wall and prevent the extremity of the rod from being dislodged from the aperture during shipment of the carton.

Further, the integral anchoring flap means can be arranged so as to cooperatively engage suitable protuberances or extensions of the packaged product for preventing shifting movement thereof in the carton and still not require the elongate pole used for packaging lamp shades.

BRIEF DESCRIPTION OF THE DRAWINGS

FIG. 1 is a plan view of a unitary blank for erection of a carton in accordance with this invention;

FIG. 2 is an elevational view of a carton erected from the blank shown in FIG. 1 and partially sectioned to reveal a typical lamp shade secured in position by a rod and the anchoring flap means of the carton according to the invention;

FIG. 3 is a top perspective view of the incompletely erected carton shown in FIG. 2 and illustrating the anchoring flap means folded inwardly in relation to the end flap to which the anchoring flap is hinged;

FIG. 4 is a fragmentary, sectional view taken along the line 4—4 of FIG. 3 and illustrating the anchoring flap means sandwiched between opposing end flaps shown in FIG. 3;

FIG. 5 is a fragmentary top perspective view of an incompletely erected modified carton in accordance with this invention, illustrating the anchoring flap means folded outwardly in relation to the end flap to which the anchoring flap is hinged; and FIG. 6 is a fragmentary side sectional view taken along the line 6—6 of FIG. 5 and illustrating the anchoring flap positioned outwardly in relation to both of the opposing end flaps.

DESCRIPTION OF THE PREFERRED EMBODIMENT

Referring to FIG. 1, the reference character 10 designates generally a carton blank having the anchoring flap means, designated generally 11, embodying the invention. Such blank preferably is formed from corrugated paperboard by precision cutting dies impacting on a web of the material in a manner well known in the art. Except for the anchoring flap means 11, the blank 10 is a conventional blank known in the trade as a R.S.C. style blank or carton to be erected from the blank. The blank includes side panels 12, 14, 16 and 18, which are hingedly connected together along fold or score lines 20. Extending outwardly from the panel 12 is the manufacturer's joint or glue flap 22 connected to panel 12 along fold line 24. The flap 22 is provided to join panel 12 internally to panel 18 to form a completed carton in a conventional manner. Attached to the side panels 12 through 18 are end flaps 26, 28, 30 and 32 and connected to opposing edges of said side panels are end flaps 27, 29, 31 and 33. Said end flaps 26 through 33 are shown as hingedly connected to the side panels along fold lines 34. The notches or slots 35 between adjacent end flaps are conventional also for convenient folding of the end flaps to form the top and bottom walls of the completed carton. The carton blank 10, so far as above described, is identical to the carton blank 10 of application Ser. No. 299,859.

Referring again to FIG. 1, each of end flaps 32 and 33 is provided with a respective, semi-circular passageway 32*a* and 33*a* positioned medially along, and generally interrupting, the respective free edge 43 opposite fold line 34. Passageways 32*a* and 33*a* can alternatively be formed as slots or similar, suitable cutouts, to provide clearance space for insertion of a rod or other protuberance through end flaps 32 and 33 as further described hereafter. Similarly, end flaps 28 and 29 can be provided with respective pasageways 28*a* and 29*a* interrupting corresponding free edges 41. Passageways 28*a* and 29*a* can be defined by conventional "perfing lines" 28*b* and 29*b* as illustrated in FIG. 1, in order to provide convenient removal by the user when clearance spaces similar to passageways 32*a* and 33*a* are required as similarly described hereafter.

It is immaterial as to which is the top or bottom wall of the completed carton since the vertical orientation of the carton will determine which is the top and which is the bottom wall thereof. Further, since these top and bottom walls are substantially identical in the embodiment illustrated in FIG. 1, reference herein to a so-called top and bottom wall should not be construed as limiting the invention to any such designated wall of the carton. In the collapsed condition of the carton, i.e., when the glue flap has been secured to panel 18, the carton is ideal for shipping in large quantities. To use the carton, pressure is applied to its edges so as to open the carton into a rectangular shape. Thereafter, the end flaps can be folded inwardly toward the storage compartment of the carton for forming the top and bottom walls thereof. First, one pair of opposing end flaps are folded inwardly and then, the second pair of end flaps are folded inwardly overlying the first end flaps. This is done for forming both the top and bottom walls of the carton. Thereafter, a length of adhesvie tape is superimposed on the joint between exterior end flaps of a wall for securement purposes. It will be appreciated that each end wall will then consist of a pair of opposed end flaps subtended by a second pair of opposed end flaps. For purposes of this invention, that pair of end flaps which subtend the second pair of end flaps will be referred to as the "interior end flaps" of a top or bottom wall of the completed carton. Thus, both the top and bottom wall of the completed carton will have a pair of such "interior end flaps" as a part thereof.

When the carton is erected, side panels 12, 14, 16 and 18 form the vertical side walls of the carton designated generally 10A in FIG. 2. In such orientation, end flaps 26, 28, 30 and 32 will form the bottom wall and end flaps 27, 29, 31 and 33 will form the top wall of the carton 10A. Referring to FIG. 1, it will be seen that the anchoring flap means 11 are provided in the top wall end flap 29 and the bottom wall end flap 28. These end flaps 28 and 29 are hingedly connected along opposite side edges of the side panel 14 along fold line 34. Each end flap 28 and 29 has a free edge 41 opposite and parallel to the fold line 34. Also, there is a slot 35 separating each end flap 28 and 29 from its adjacent end flap as viewed in FIG. 1.

End flap 28 has a medial flap 36 formed entirely within the body portion thereof. Said flap 36 is hinged to flap 28 along score line 38 which is generally parallel to edge 41 and score line 34. The flap 36 is generally rectangular as designated by hinge line 38 and the U-shaped cut line 40. The flap 38 has an aperture 42 therethrough selectively relative to the hinge line 38 and the cut line 40A.

Referring to flap 29, it also has a flap 52 hingedly connected along fold line 54 and defined by a U-shaped cut line 55 similar to the cut line 40 but opposite in direction. The flap 52 also has a medial aperture 56 therethrough. The flaps 36 and 52 cooperate to provide the integral, anchoring flap means of the invention, as hereinafter will be explained.

The flap 28 and 29 are identical in configuration and dimension. Likewise, flaps 32 and 33 are so configured in dimension as are the flaps 26, 27, 30 and 31. In erecting the carton 10A, the rectangular compartment of the carton is formed by unfolding the side walls 12 through 18. To form the bottom wall of the carton, first end flaps 28 and 32 are folded inwardly toward one another. Because of their divided dimensions, they will meet generally along opposing eges 41 at the proximate midpoint between opposing side walls 14 and 18. The opposite end flaps 26 and 30 would then be folded inwardly to overlie said end flaps 28 and 32 which are on the interior of the carton. The end flaps 30 and 26 will have proximate edges 41A which will likewise meet at a midpoint of the carton so that a strip of adhesive tape can be affixed over these edges to form a joint in a conventional manner.

The top wall of the carton would be formed in the same way. First, end flaps 29 and 33 are folded inwardly to meet along a midpoint between side walls 14 and 18. Then, end flaps 27 and 31 would be folded inwardly to overlie the subtended end flaps 29 and 33 and be secured along faced edges by means of a strip of tape. Here also, the top wall would be formed by a pair of interior end flaps 29 and 33 subtended by end flaps 27 and 31.

To explain the use of the anchoring flap means 36 and 52 of the invention, the procedure for folding the top end formation of carton 10A will be described with reference to FIGS. 3, 2 and 4. End flap 33 is folded inwardly. The anchoring flap 52 is rotated inwardly 180 degrees along score line 54 into back-to-back engagement with end flap 29. End flap 29 is then folded inwardly until portion 52*a* of anchoring flap 52 overlaps and engages the outer surface of end flap 33; the resulting engagement of anchoring flap 52 with end flap 33 aligns semi-circular passageway 33*a* below aperture 56. The central alignment of passageway 33*a* and aperture 56 is selected further to register with an aperture 46 formed in the washer fitter 47 of a typical lamp shade 48, as illustrated in FIG. 2. The passageway 33*a* allows clearance through end flap 33 for insertion of rod 50 vertically through the aligned aperture 56 and 46 so that the extremity of rod 50 is received in aperture 56 of the anchoring flap 52. As illustrated in FIGS. 2 and 4, the offset sandwiched position of anchoring flap 52 outwardly from end flap 33 and inwardly from end flap 29 eliminates any tendency of the anchoring flap 52 to unfold or rotate from such sandwiched position in the fully erected carton. FIG. 2 illustrates that the top wall of the carton is completed by folding end flaps 27 and 31 inwardly to overlie end flaps 29 and 33. Thereafter tape is applied as previously described to complete erection of the carton.

As illustrated in FIG. 2, the bottom wall of the carton can be assembled in a manner similar to that for assembly of the top wall. Typically, the bottom wall will have been assembled first. Thus, end flap 32 is folded inwardly and then, anchoring flap 36 is rotated 180 degrees inwardly along score line 38 into back-to-back engagement with end flap 28. Flap 28 then is folded inwardly to sandwich anchoring flap 36 outwardly upon end flap 32 and inwardly of flap 28. The sandwiched position of anchoring flap 36 aligns semi-circular passageway 32*a* inwardly from aperture 42 in further alignment with washer fitter aperture 46. Passageway 32*a* does provides clearance for the insertion of the other extremity of rod 50 through flap 32 for reception in the outwardly positioned anchoring flap 36, as illustrated in FIG. 2. After rod 50 has been inserted through the washer fitter aperture 46 and the extremities of the rod have been secured within respective anchoring flaps 36 and 52, the lamp shade is prevented from shifting within the carton during shipment.

In the particular construction illustrated in FIG. 2, rod 50 has been fabricated in two sections which can be joined at the location of the washer fitter 47 by tenon and mortise or similar conventional joint 51 in order to suspend the lamp shade 48 within carton 10A. Typically, rod 50 can be a wooden blank or light metal member having a diameter of approximately $\frac{1}{4}$ inch to $\frac{1}{2}$ inch, and the anchoring flap apertures 42 and 56 are similarly dimensioned to receive the extremities of the rod 50.

FIGS. 5 and 6 illustrate a modified embodiment of the carton 10A in which the anchoring flap 52 is folded outwardly 180 degrees along score line 54 into back-to-back engagement with flap 29. To assemble the top wall of the carton as illustrated in FIGS. 5 and 6, end flap 33 is folded inwardly, and then end flap 29 is folded toward end flap 33 so that in addition to anchoring flap 52 being positioned back-to-back and outwardly of flap 29, overlaping portion 52*a* is positioned to outwardly engage flap 33.

FIG. 6 illustrates that such folding of flaps 29 and 33 results in the alignment of passageway 33*a* inwardly from aperture 56, but in addition, also requires passageway 29*a* formed through flap 29 to be similarly aligned with aperture 56 in order to allow clearance for the insertion of rod 50 through both of flaps 29 and 33 so that the extremity of the rod 50 is received within the apertue 56. Anchoring flap 52 is positioned outwardly from both end flaps 29 and 33 as illustrated in FIG. 6. As illustrated in FIG. 6, passageways 29*a* and 33*a* adjoin, generally in the same plane, in order to provide clearance for rod 50 through flaps 29 and 33. Passageway 29*a* is indicated by perfing line 29*b* in the blank 10 illustrated in FIG. 1. After folding end flaps 27 and 31 inwardly to overlie flaps 29 and 33 as well as aperture 56, flaps 27 and 31 can be taped at their juncture as previously described.

In both of the illustrated folding variations for carton 10A, the anchoring flaps 36 and 52 can be provided within respective opposing end flaps 28 and 29 which are hinged on opposite edges of the same side panel 14. Such formation of anchoring flaps 36 and 52 results in said anchoring flaps being mirror images of each other, as seen in FIG. 2. However, such mirror structure of said anchoring flaps 36 and 52 is not absolutely essential.

It is believed that the thrust of the invention can be understood and appreciated from the foregoing description, keeping in mind that variation in dimensions and minor features of construction may be resorted to without departing from the scope of the invention as will be claimed hereinafter. For instance, variations in diameter of the rod 50 may be resorted to; the rod may be made in one or more sections, so long as it is of sufficient length to permit extremities thereof to be suitably engaged in the apertures of the anchoring flap members.

What is desired to claim is:

1. A shipping carton formed from an integral blank of foldable paperboard material comprising, a plurality of sidewall panels hingedly connected together, one of said sidewall panels having a hinged manufacturer's joint extending therefrom for securement to another sidewall panel to form a rectangular enclosure, said sidewall panels having opposite edges along which a respective end flap member is hingedly secured, the pair of end flap members hingedly secured to one of said sidewall panels having integral anchoring flap means hingedly connected along a hinge line parallel to and spaced from the hinge line connection of the end flap to the sidewall panel, said anchoring flap means including apertures therethrough aligned along a vertical axis on the interior of the carton when the end flaps are inwardly folded to form the respective top and bottom walls of the carton, wherein said anchoring flap means are positioned in generally back-to-back configuration with said end flaps to which they are respectively connected and a portion of each of said anchoring flap means generally overlaps a respective opposing one of said end flaps, at least one of said opposing end flaps includes a clearance passageway therethrough, said passageway being generally aligned with the aperture in said respective anchoring flap means, said anchoring flap means being located to engage protuberances of a packaged product for preventing shifting of the product during shipment of the carton.

2. The carton as claimed in claim 1, wherein said anchoring flap is folded into generally sandwiched position outwardly with respect to said opposing end flap and inwardly with respect to said respective end flap to which said anchoring flap is hindgedly connected.

3. The carton as claimed in claim 1 or 2, wherein said aligned apertures are positioned at substantially the respective centers of said top and bottom walls of said carton.

4. The carton as claimed in claim 1 or 2, wherein said anchoring flaps are positioned in substantially mirror image alignment.

5. The carton as claimed in claim 1 or 2, wherein said passageway is formed as a generally semi-circular cutout.

6. A shipping carton formed from an integral blank of foldable paperboard material comprising, a plurality of sidewall panels hingedly connected together, one of said sidewall panels having a hinged manufacturer's joint extending therefrom for securement to another sidewall panel to form a rectangular enclosure, said sidewall panels having opposite edges along which a respective end flap member is hingedly secured, the pair of end flap members hingedly secured to one of said sidewall panels having integral anchoring flap means hingedly connected along a hinge line parallel to and spaced from the hinge line connection of the end flap to the sidewall panel, said anchoring flap means including apertures therethrough aligned along a vertical axis on the interior of the carton when the end flaps are inwardly folded to form the respective top and bottom walls of the carton, wherein said anchoring flap means are positioned in generally back-to-back configuration with said end flaps to which they are respectively connected and a portion of each of said anchoring flap means generally overlaps a respective opposing one of said end flaps, each of said opposing end flap and said respective end flap hinged to said anchoring flap means has a clearance passageway formed therein, said passageways being opposingly adjoined in general alignment with the aperture of said respective anchoring flap means, said anchoring flap means being located to engage protuberances of a packaged product for preventing shifting of the product during shipment of the carton.

7. The carton as claimed in claim 6, wherein said anchoring flap is folded outwardly with respect to the interior of the carton so that said anchoring flap is positioned outwardly with respect to both said end flap to which said anchoring flap is hingedly connected and said respective opposing end flap.

8. The carton as claimed in claim 6, wherein said aligned apertures are positioned at substantially the respective centers of said top and bottom walls of said carton.

9. The carton as claimed in claim 7, wherein said anchoring flaps are positioned in substantially mirror image alignment.

10. The carton as claimed in claim 7, wherein at least one of said clearance passageways is formed as a generally semi-circular cutout.

11. The carton as claimed in claim 2, 3 or 7, wherein at least one said passageway is located medially interrupting a free edge formed opposing the hinged connection of said respective end flap member to said side wall panel.

12. A foldable unitary blank of paperboard material or the like for erection of a shipping carton, comprising a plurality of side wall panels hingedly connected together, one of said side wall panels having a hinged manufacturer's joint extending therefrom for securement to another side wall panel to form a rectangular enclosure in the erected carton, said side wall panels having opposite edges along which a respective end flap member is hingedly secured, the pair of end flap members hingedly secured to one of said side wall panels having integral anchoring flap means hingedly connected along a hinge line parallel to and spaced from the hinge line connection of the end flap to the side wall panel, said anchoring flap means including aligned apertures therethrough for engagement of protuberances on a product packaged in the erected carton when the end flaps are inwardly folded to form the respective top and bottom walls of the carton, wherein at least one of said end flap members includes a clearance passageway therethrough, said passageway being aligned with said apertures in the erected carton to provide clearance for passage of said protuberance through said end flap member.

13. The blank as claimed in claim 12, wherein said passageway is formed through one of said end flap members opposing, in said erected carton, said end flap member hinged to said anchoring flap means.

14. The blank as claimed in claim 12, wherein a second passageway is formed through said end flap member hinged to said anchoring flap means.

15. The blank as claimed in claim 12, 13 or 14, wherein said passageway is located medially interrupting a free edge formed opposing the hinged connection of said end flap member to said side wall panel.

16. A shipping carton formed from an integral blank of foldable paperboard material comprising:

1. a plurality of sidewall panels hingedly connected together, one of said panels having a hinged manufacturer's closure joint for securement to another sidewall panel to form a carton enclosure;
2. said sidewall panels each having an end flap member hingedly secured along a marginal edge of the panel, said end flap members folded inwardly in overlapping substantially parallel arrangement to form the respective top and bottom walls of the carton;
3. said top and bottom walls having anchoring flap means integrally formed in the end flaps thereof with said means having apertures therethrough aligned along a vertical axis facing inwardly toward said carton enclosure;
4. said anchoring flap means comprising a flap member hingedly secured to an inner portion of the contiguous end flap member and positioned in a plane substantially parallel to the planes of the end flap members forming said top and bottom walls and clearance passageways in other of said end flap members in alignment with said apertures; and
5. said anchoring flap means located to expose said apertures thereof to engage protuberances of a product packaged in the carton for preventing shifting of the product during shipment of the carton.

17. A shipping carton as described in claim 16 in which said anchoring flap means includes clearance passageways in opposing end flap members in alignment with said apertures to permit the protuberance to be extended therethrough.

* * * * *